US011078665B2

(12) United States Patent
Daudet

(10) Patent No.: US 11,078,665 B2
(45) Date of Patent: Aug. 3, 2021

(54) BOX HEAD CONNECTOR

(71) Applicant: Simpson Strong-Tie Company Inc., Pleasanton, CA (US)

(72) Inventor: Larry Randall Daudet, Brentwood, CA (US)

(73) Assignee: Simpson Strong-Tie Company, Inc., Pleasanton, CA (US)

( * ) Notice: Subject to any disclaimer, the term of this patent is extended or adjusted under 35 U.S.C. 154(b) by 0 days.

(21) Appl. No.: 16/179,622

(22) Filed: Nov. 2, 2018

(65) Prior Publication Data

US 2019/0136520 A1 May 9, 2019

Related U.S. Application Data

(60) Provisional application No. 62/581,631, filed on Nov. 3, 2017.

(51) Int. Cl.

| | |
|---|---|
| ***E04B 2/62*** | (2006.01) |
| ***E04B 1/24*** | (2006.01) |
| ***E04B 2/76*** | (2006.01) |
| ***E04B 1/26*** | (2006.01) |

(52) U.S. Cl.

CPC ..... *E04B 2/766* (2013.01); *E04B 1/2403* (2013.01); *E04B 1/2608* (2013.01); *E04B 2/62* (2013.01); *E04B 2001/2415* (2013.01); *E04B 2001/2644* (2013.01)

(58) Field of Classification Search

CPC ..... E04B 2/766; E04B 1/2608; E04B 1/2403; E04B 2001/2644; E04B 2001/2415; E04B 2/62

USPC ..... 52/92.2, 715, 712, 713, 714, 696; 403/231

See application file for complete search history.

(56) References Cited

U.S. PATENT DOCUMENTS

| | | | | |
|---|---|---|---|---|
| 451,596 | A * | 5/1891 | Longenecker | E06B 3/667 52/656.9 |
| 933,067 | A * | 9/1909 | Ferry | F16B 12/46 403/205 |
| 1,419,608 | A * | 6/1922 | Brendza | E06B 3/984 403/231 |
| 2,365,501 | A * | 12/1944 | Walstrom | E04B 1/2604 403/174 |
| 3,425,720 | A * | 2/1969 | Spane | E04B 1/2604 403/247 |
| 4,572,695 | A * | 2/1986 | Gilb | E04B 1/2608 248/300 |

(Continued)

OTHER PUBLICATIONS

Simpson Strong-Tie Company, Inc., *Simpson Strong-Tie Connectors—1985 Connectors for Wood Construction* , Jan. 1985, pp. 26, 36, cover page, Catalog 85H-1, Simpson Strong-Tie Company, Inc., USA.

(Continued)

*Primary Examiner* — Brent W Herring
(74) *Attorney, Agent, or Firm* — James R. Cypher; Charles R. Cypher

(57) ABSTRACT

A connector is provided that minimizes the surface profile of a connection between a header and a vertical member. The portion of the connector that engages the side surface of the vertical member and the horizontal member has a notched section such that the connector does not over-lie the flaring lower portion of the header.

17 Claims, 9 Drawing Sheets

(56) References Cited

U.S. PATENT DOCUMENTS 5,150,982 A * 9/1992 Gilb ..... E01D 19/103 403/232.1
5,403,110 A * 4/1995 Sammann ..... E04B 1/5831 403/205
5,697,725 A * 12/1997 Ballash ..... E04B 1/2608 403/231
5,797,694 A 8/1998 Breivik
6,047,503 A * 4/2000 Kost ..... E04B 1/10 52/79.9
6,094,880 A 8/2000 Thompson
6,230,467 B1 5/2001 Leek
6,295,781 B1 * 10/2001 Thompson ..... E04B 1/2608 403/232.1
6,640,516 B1 * 11/2003 Thompson ..... E04B 1/2608 52/712
7,254,919 B2 8/2007 Lutz et al.
7,634,889 B1 * 12/2009 diGirolamo ..... E04B 1/2403 403/232.1
7,805,894 B2 * 10/2010 Contasti ..... E04B 1/2608 411/461
7,971,409 B2 7/2011 Bak et al.
8,615,942 B2 12/2013 Lafreniere
8,834,057 B2 * 9/2014 Adams, Jr. ..... F16B 7/04 29/525.02
8,910,367 B2 * 12/2014 Adams, Jr. ..... F16B 7/04 29/525.02
D730,545 S * 5/2015 Stauffer ..... D25/133
9,200,653 B2 * 12/2015 Adams, Jr. ..... F16B 7/04
9,376,797 B2 * 6/2016 Yang ..... E04B 1/24
10,273,678 B2 * 4/2019 Hensen ..... E04B 1/2608
10,745,902 B1 * 8/2020 Getz ..... E04B 1/2403
2002/0112439 A1 * 8/2002 Rosas ..... E04B 1/2608 52/712
2006/0096201 A1 * 5/2006 Daudet ..... E04B 1/24 52/272
2008/0134620 A1 * 6/2008 Contasti ..... E04B 1/2608 52/712
2008/0244993 A1 * 10/2008 Crumley ..... E04B 7/045 52/92.2
2010/0011697 A1 * 1/2010 Nguyen ..... E04B 7/045 52/714
2011/0005145 A1 * 1/2011 Contasti ..... E04B 1/2608 52/98
2011/0252743 A1 * 10/2011 Yang ..... E04B 1/2403 52/849
2014/0083046 A1 * 3/2014 Yang ..... E04B 1/24 52/704
2016/0177560 A1 * 6/2016 Hensen ..... E04B 1/2608 52/272

OTHER PUBLICATIONS

Simpson Strong-Tie Company, Inc., *Simpson Strong-Tie—Wood Construction Connectors* , 2006, pp. 52, cover page, Catalog C2006, Simpson Strong-Tie Company, Inc., USA.
The Steel Network, Inc., *Stiff Clip HE* , Nov. 2016, 2 pages, The Steel Network, Inc., USA.

* cited by examiner

BOX HEAD CONNECTOR

BACKGROUND OF THE INVENTION

The present invention provides a connector for making a connection between two structural members in a building, and in particular for joining a header to a vertical upright.

U.S. Pat. No. 7,634,889, invented by di Girolamo, Torres and Abdel-Rahman teaches an L-shaped bracket for making such a connection between a header and a vertical upright where the header does not rest upon a top surface of the vertical stud, but instead abuts the vertical face of the stud. The L-shaped bracket attaches to the underside of the header and to the vertical face of the stud. A side flange projects from the portion of the L-shaped bracket attached to the underside of the header. The side flange overlies a portion of a side surface of the header and at least a portion of a vertical side surface of the stud. The L-shaped bracket is connected to the header and to the vertical stud with fasteners and the side flange is connected to the header and the vertical stud with fasteners.

U.S. Pat. No. 8,615,942, invented by Dennis P. Lafreniere teaches a hanger for making a connection between a header and a vertical jamb stud where the header does not rest upon a horizontal surface of the jamb stud. The hanger has a back member which is attached to the vertical stud and a seat and side members which receive the header.

SUMMARY OF THE INVENTION

The present invention provides a connection between a vertical member and a horizontal member made with a connector where the end of the horizontal member abuts or lies closely adjacent the vertical end face of the of the vertical member such that the vertical member does not have a ledge or other supporting surface on which the horizontal member rests.

The present invention provides a connector for the connection where the connector minimizes the surface profile of the connection. This object is accomplished by providing the portion of the connector that engages the side surface of the vertical member and the horizontal member with a notched or coped section such that the side plate of the connector does not over-lie the flaring lower portion of the header. This prevents what is called dry-wall build-up. In most building situations the connection will be covered with dry-wall or gypsum board panels. Preferably, the underlying structural member for the dry-wall panels are generally uniform in profile such that dry-wall can be attached to the underlying members and the outer surface of the dry-wall panels present a uniform flat profile.

The present invention also provides a connector where the openings for the fasteners that attach the connector to the vertical supporting members and the horizontally disposed supported member are arranged in such a manner that different sizes of vertical support members and horizontal supported members can be used with the connector, while minimizing the number of fasteners that are needed to make the connector and support desired loads imposed on the connection.

The arrangement of fastener openings on the side plate for attachment to the vertically disposed members can accommodate vertical members that are 1⅝", 2", 2½", 3" and 3½" wide. The connector is dimensioned and the fastener openings are placed in the connector such that two vertical columns of fasteners can be placed side-by-side in a vertical member that is only 1⅝" wide. Similarly, if two vertical members will be used to carry the load of the connection, the openings in the connector are arranged such that a vertical column of fasteners can be placed in both of the vertical studs.

DETAILED DESCRIPTION OF THE INVENTION

Figure 1:
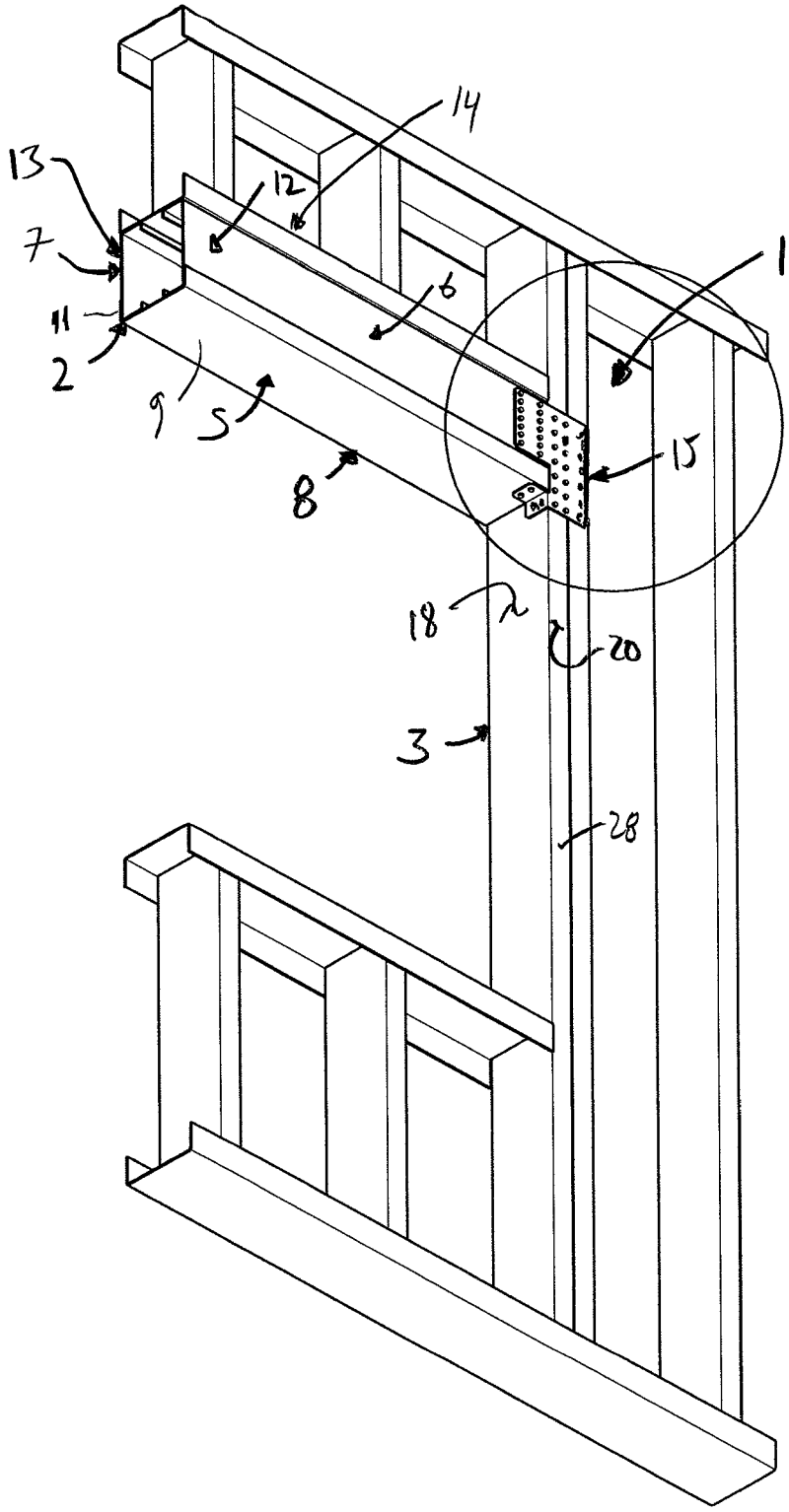
FIG. 1 is a perspective view of the connection of the present invention.

The connection 1 of the present invention is made between a horizontal member 2 and a vertical member 3. The horizontal member has an end 4, a bottom face 5 and at least one side face 6. As shown in FIG. 1, the horizontal member has a second side face 7.

The horizontal member can be made up of a number of component pieces. As shown in the figures, the horizontal member is made up of a plurality of C-shaped members. A bottom c-shaped member or track 8 is oriented such that its central web member 9 is disposed horizontally, and the central web member of the bottom c-shaped member constitutes the bottom surface or face of the header. The track 9 has two side flanges 10 and 11 projecting away from the central web in the same direction. Small return flanges can also be provided on the track. The header is also formed with a pair of c-shaped members or side member 12 and 13 where the central web members of the upstanding c-shaped members are disposed vertically. The C-shaped members each have a central web member and two end flange members projecting from the central web member in the same direction at the edges of the central web member. The bottom c-shaped member 8 supports and partially encloses the upstanding c-shaped members 12 and 13. Each of the side members 12 and 13 is situated in the bottom c-shaped member 8 such that one of the end flange members of the bottom c-shaped member interfaces with the central web of one of the upstanding c-shaped members. The lower end flanges of each of the upstanding c-shaped members interfaces with the central web of the bottom c-shaped member. The central webs of the side members and the end flanges of the bottom c-shaped member make up the side faces of the horizontal member. The horizontal member can also have a top track 14 that is also a c-shaped member that rests on the side members 12 and 13.

The side faces of the horizontal member formed in this manner with the bottom c-shaped member receiving the upstanding c-shaped members is not perfectly flat as the side or end flanges of the bottom c-shaped member jut out a little more than the surfaces of the central webs of the side members. This flaring or jutting out of the end flanges of the bottom c-shaped member makes it difficult to connect the horizontal header to the vertical members while keeping a low profile.

Figure 5:
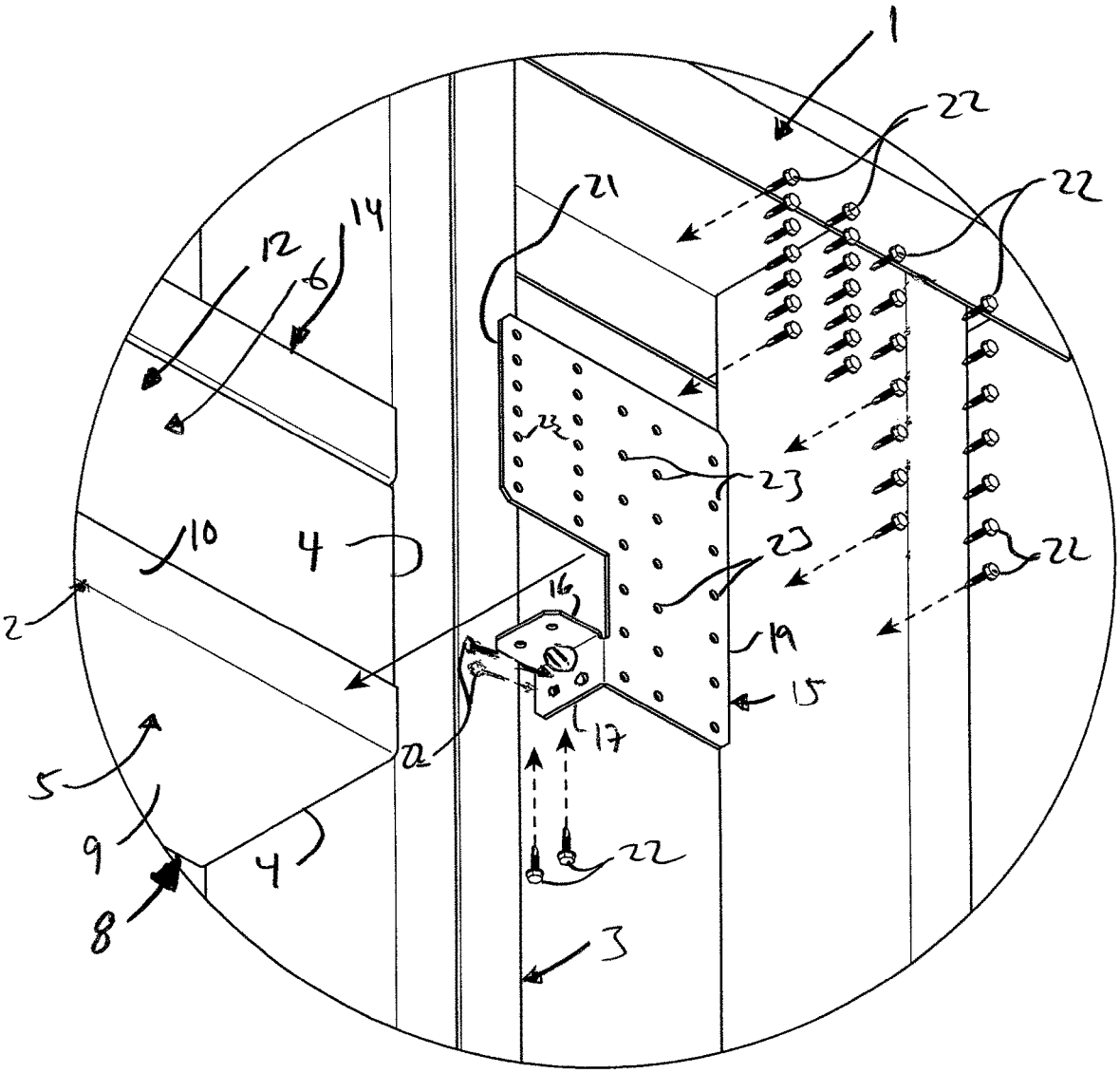
FIG. 5 is a partially exploded view of the connection of FIG. 3.
Figure 6:
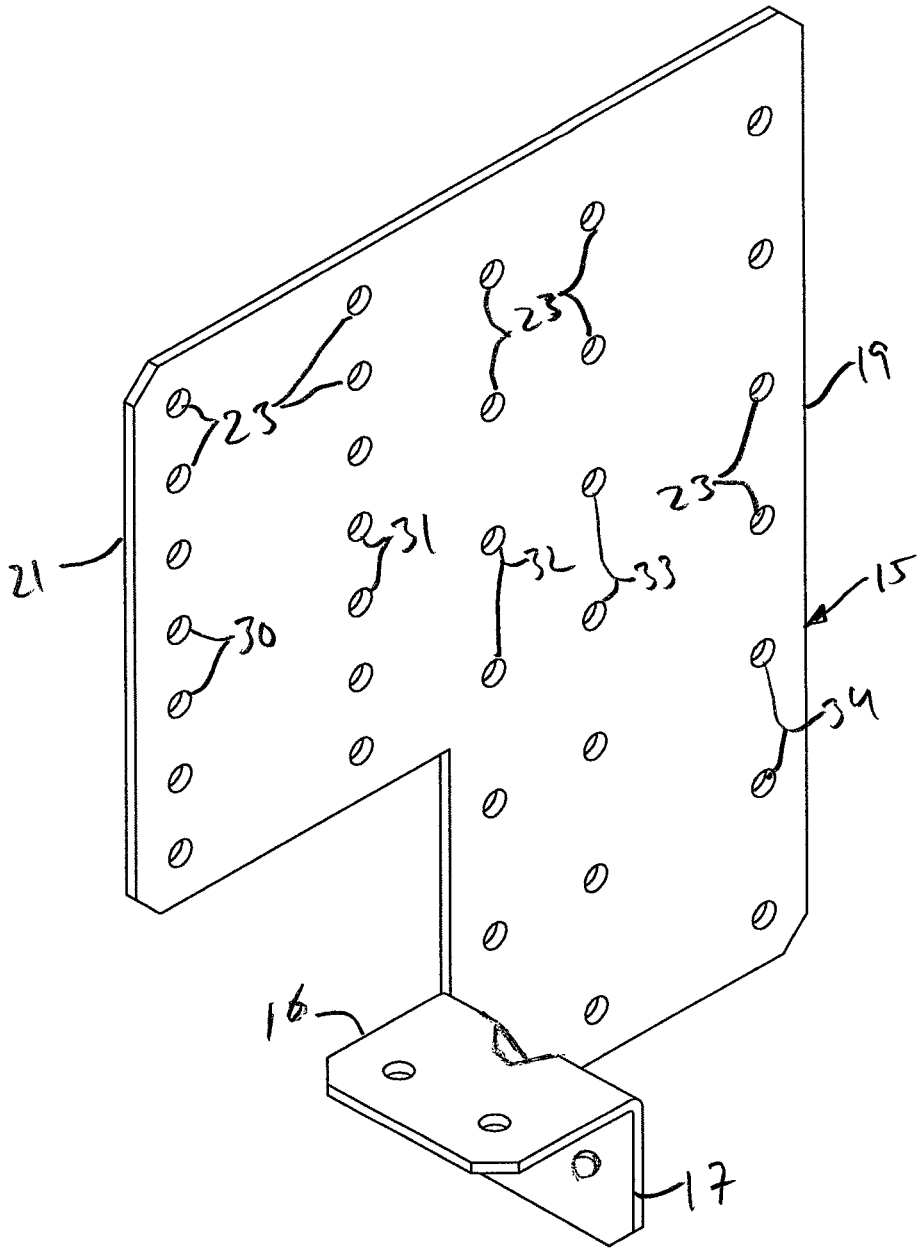
FIG. 6 is a perspective view of connector of the present invention for attaching to the opposite sides of the vertical and horizontal member.
Figure 7:
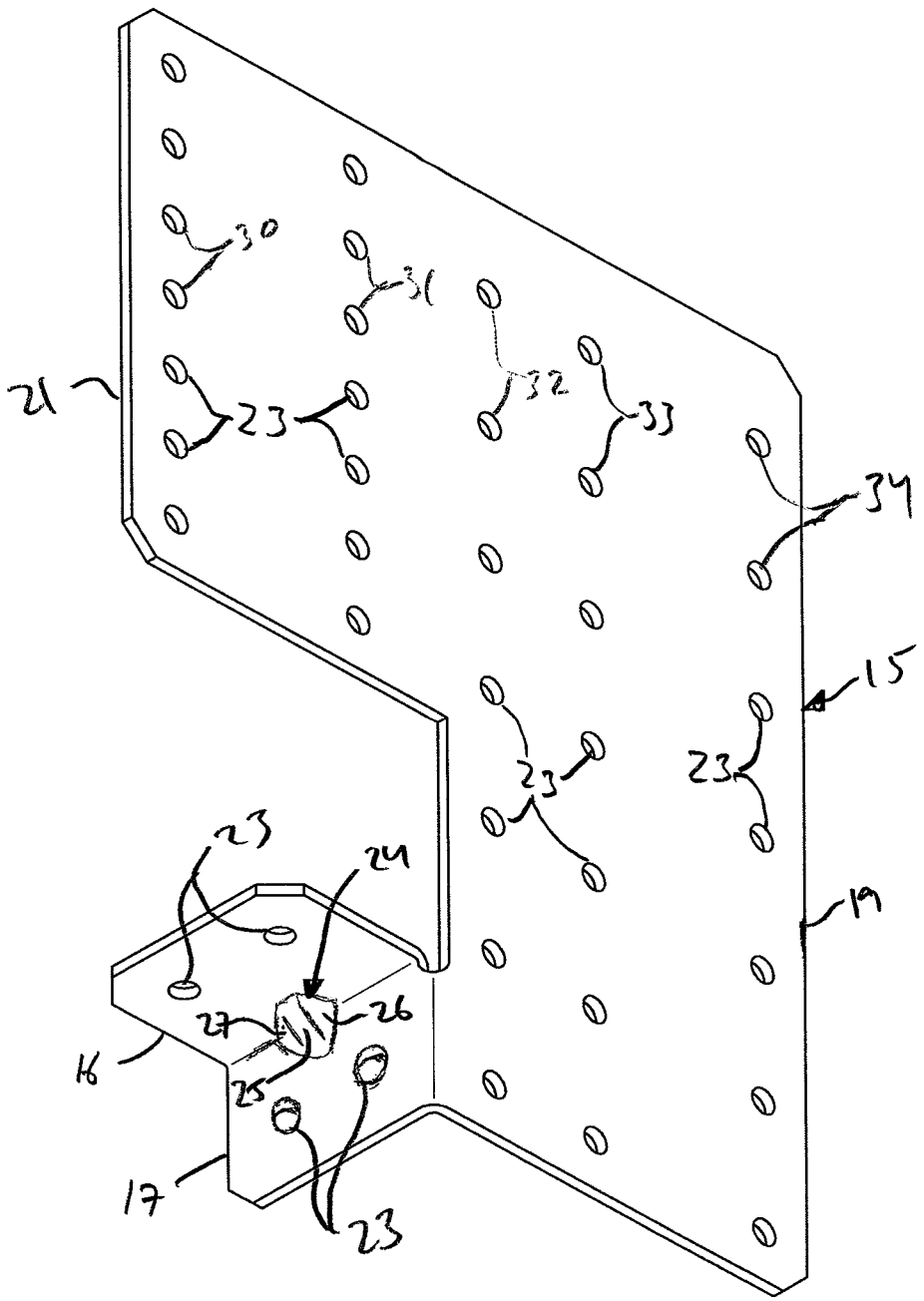
FIG. 7 is a perspective view of the connector of the present invention.
Figure 8:
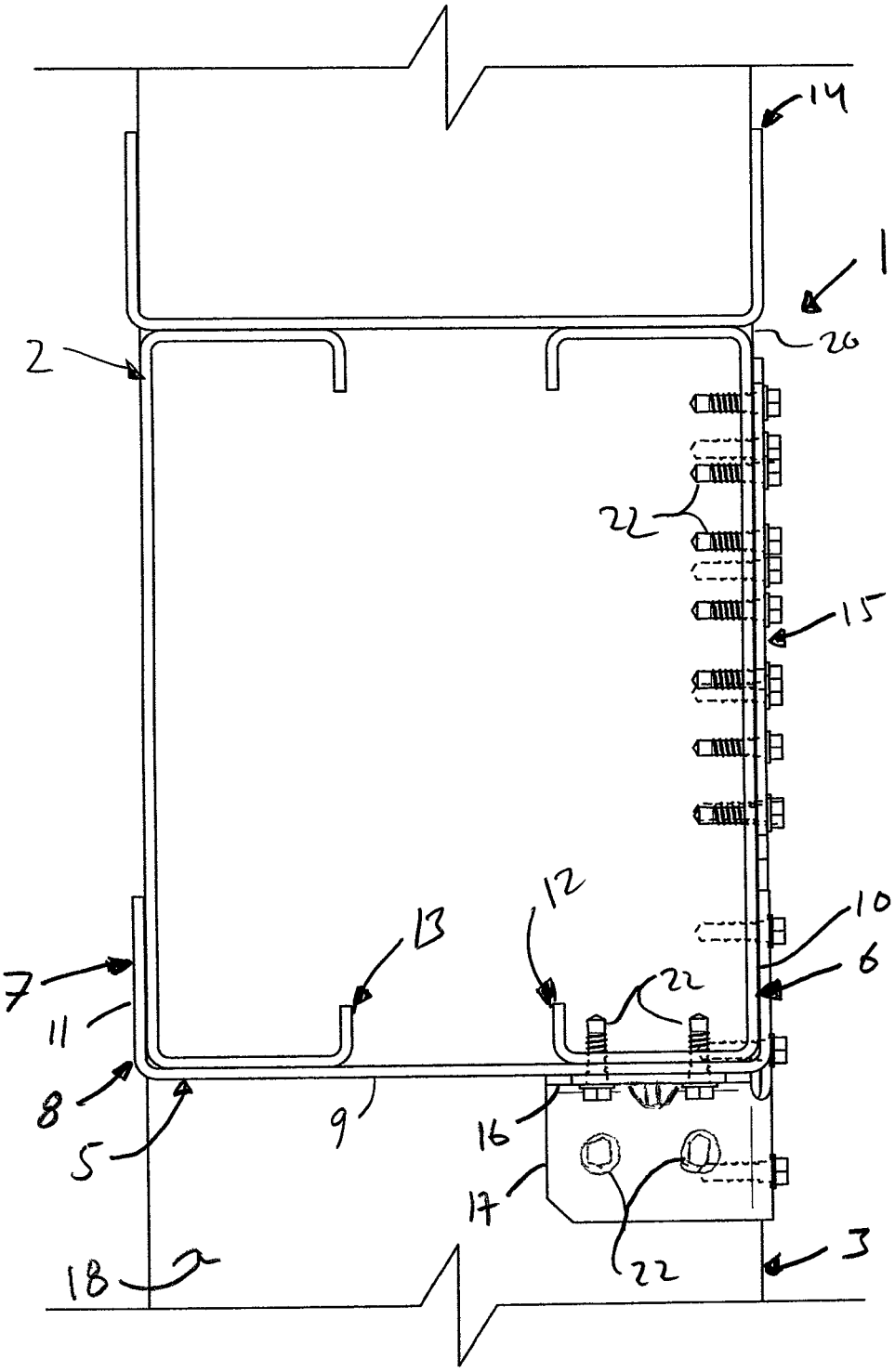
FIG. 8 is cross-sectional end view of the connection of FIG. 3.

As shown in FIGS. 1 and 5, in the connection between a vertical member and a horizontal member made with the connector of the present invention, the end of the horizontal member abuts or lies closely adjacent the vertical end face of the vertical member. The vertical member does not have a ledge or other supporting surface on which the horizontal member rests.

As shown in FIG. 1, the connector 15 has a first plate 16 which attaches to the underside of the header and a second plate 17 which is connected to the web vertical face 18 of the stud or vertical member. The first and second plates are joined to each other at a bend. In the connection, the first plate is disposed horizontally and the second plate is disposed vertically. The first and second plates are disposed orthogonally to each other with the first plate interfacing with the bottom surface of the horizontal member and the second plate interfacing with the web vertical face of the vertical member. A side flange 19 projects from the second plate. The side flange is disposed orthogonally to the second plate and is joined to the second plate at a vertical bend. The side flange extends upwardly along the vertical side surface 20 of the vertically disposed stud and is bent back away from the opening bounded by the vertical member and the horizontal member and toward the vertical member. The side flange is spaced away or at least does not overlie the side surface of the horizontal member. The side flange extends along the end of the horizontal member. The side flange has an extension 21 that extends in the plane of the side flange along the side surface of the horizontally disposed header. The side flange and extension together overlie a portion of a side surface of the header and a portion of a vertical side surface of the stud. The first and second plates are connected to the header and to the vertical member with fasteners 22 and the side flange and extension and connected to the header and the vertical stud with fasteners 22. The extension of the side flange is dimensioned so that the side flange of the connector does not over-lie the flaring lower portion of the header. There is a free space in the connector between the extension and the first plate. The extension does not overlie the side flange of the bottom track of the horizontal member. The connector is made with fastener openings 23 for receiving fasteners.

A relatively small gusset dart 24 is provided at the bend between the first and second plates. The gusset dart is formed from material from the first and second plates. The gusset dart has a central rib 25 that extends from the first plate to the second plate and flaring side walls 26 and 27.

Figure 2:
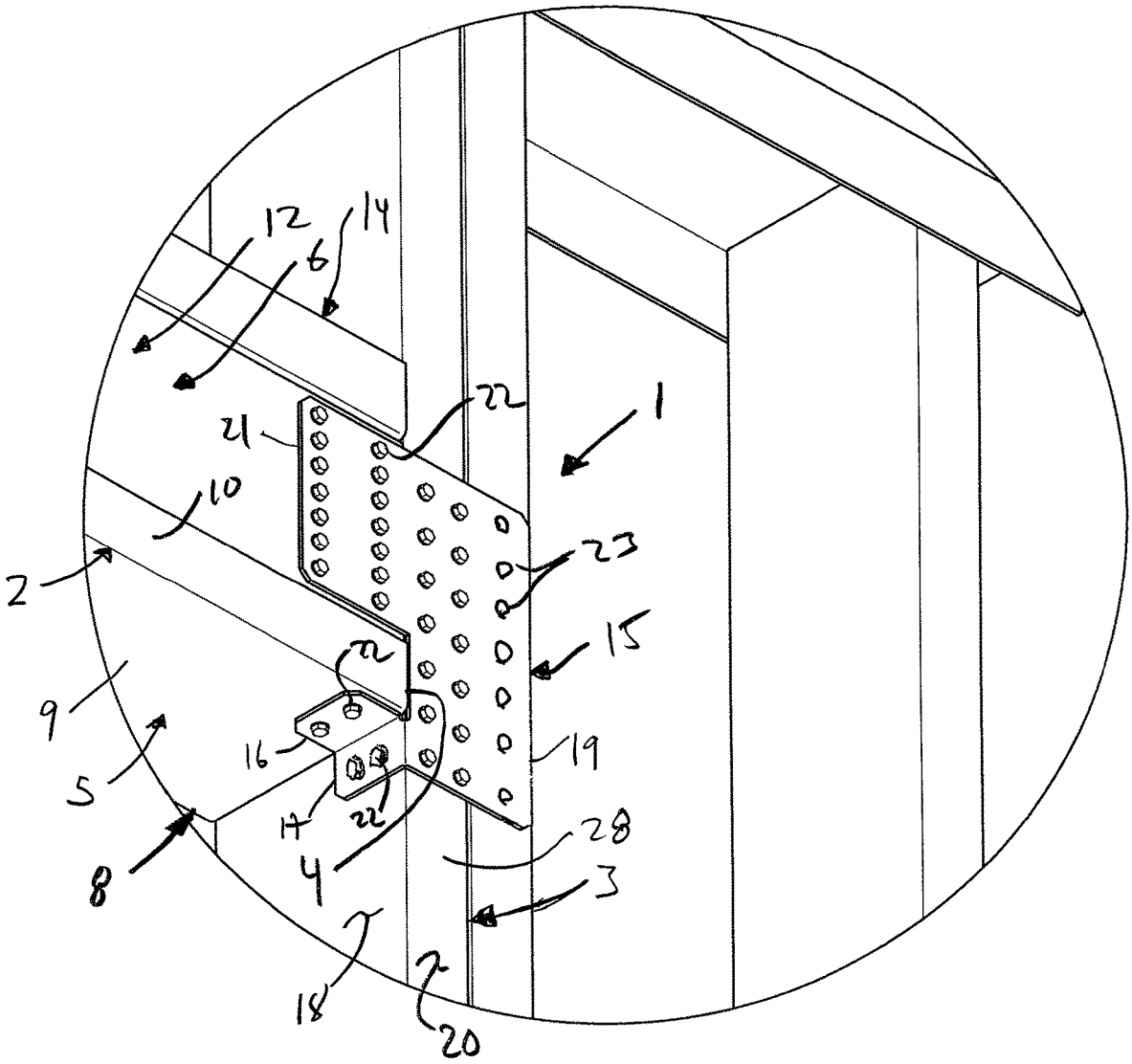
FIG. 2 is a close-up perspective view of the connection of FIG. 1.
Figure 3:
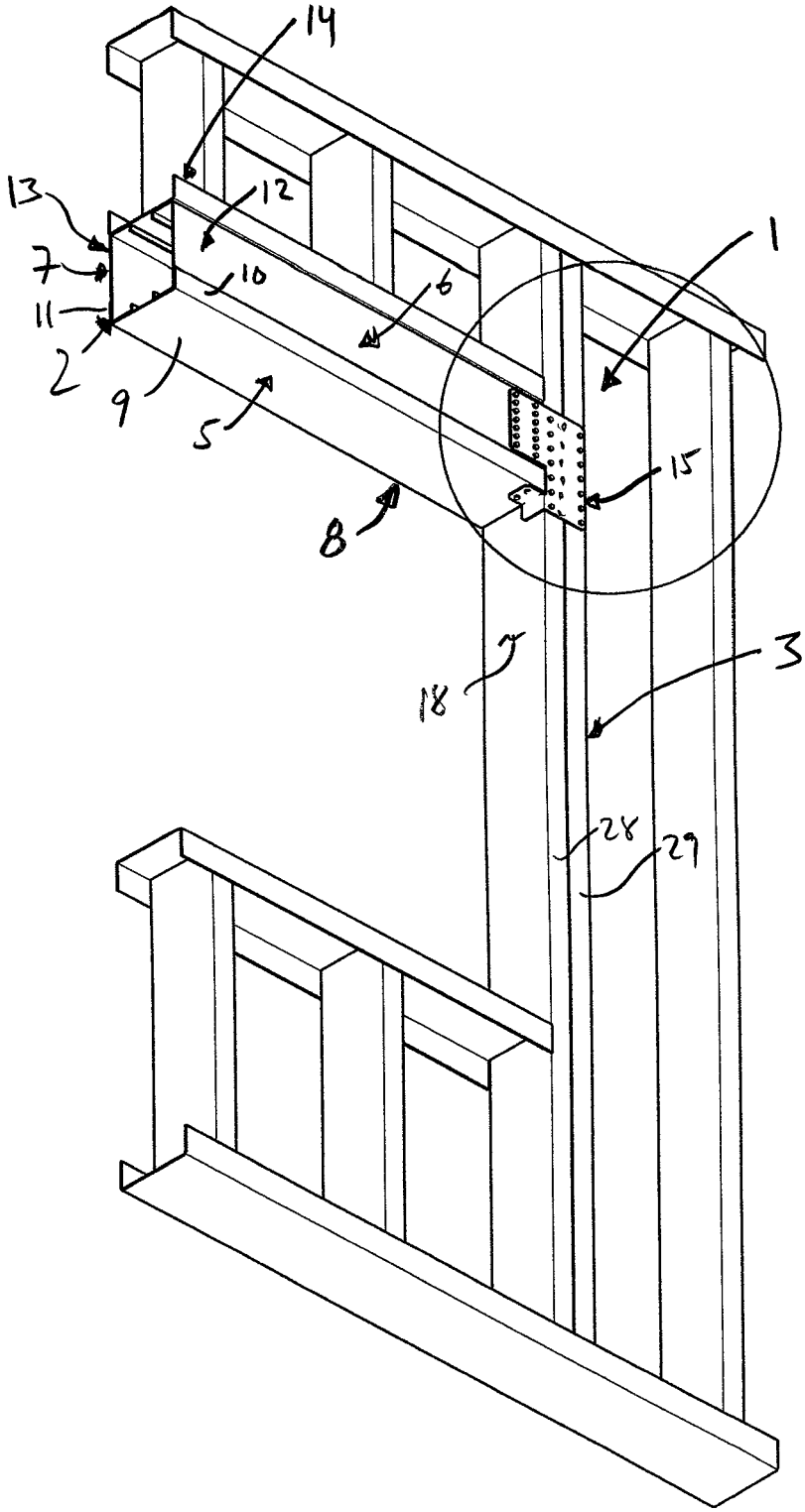
FIG. 3 is a perspective view of the connection of the present invention with the fasteners placed in different locations for attachment to the vertically disposed jamb studs.
Figure 4:
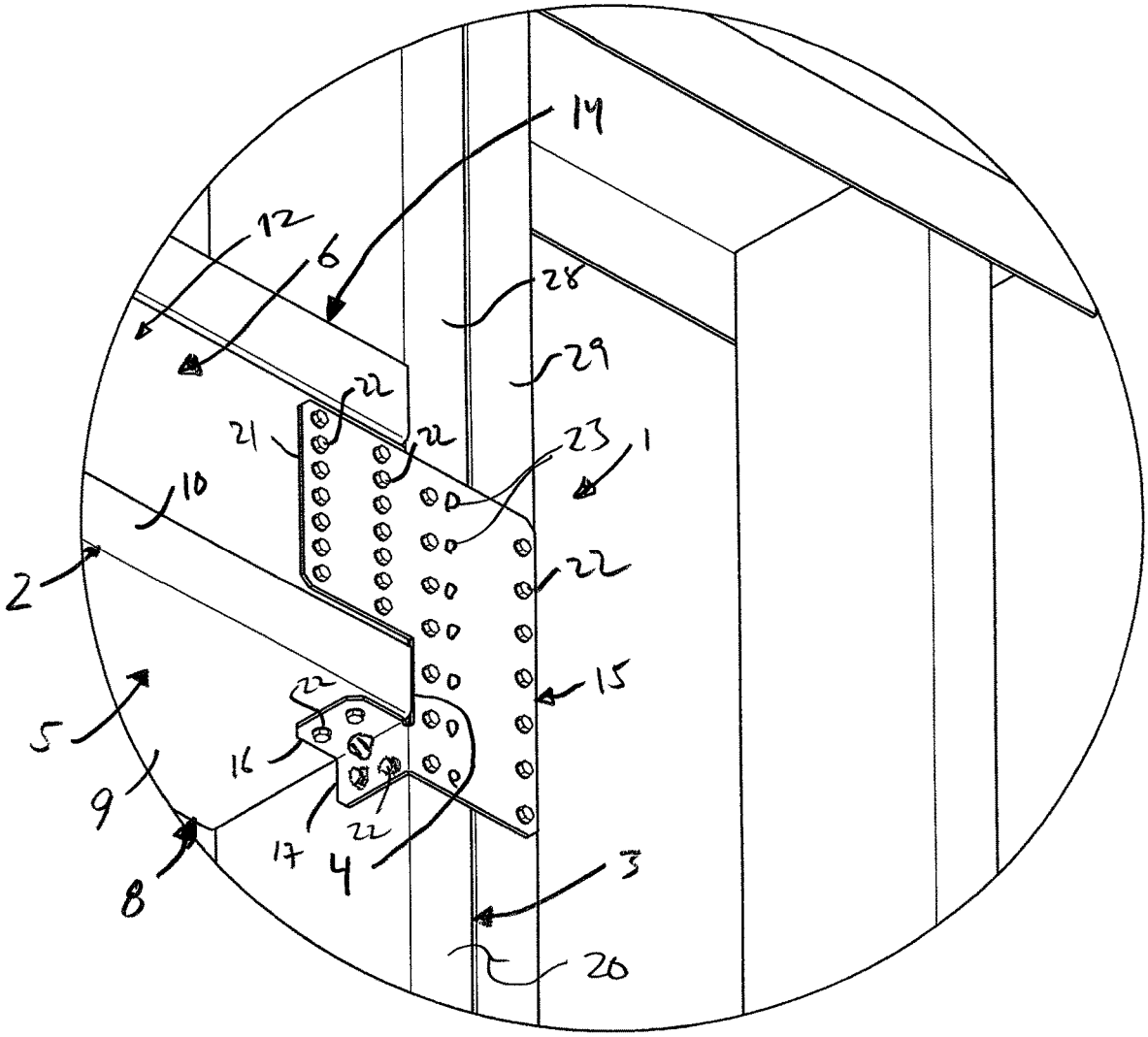
FIG. 4 is a close-up perspective view of the connection of FIG. 3.
Figure 9:
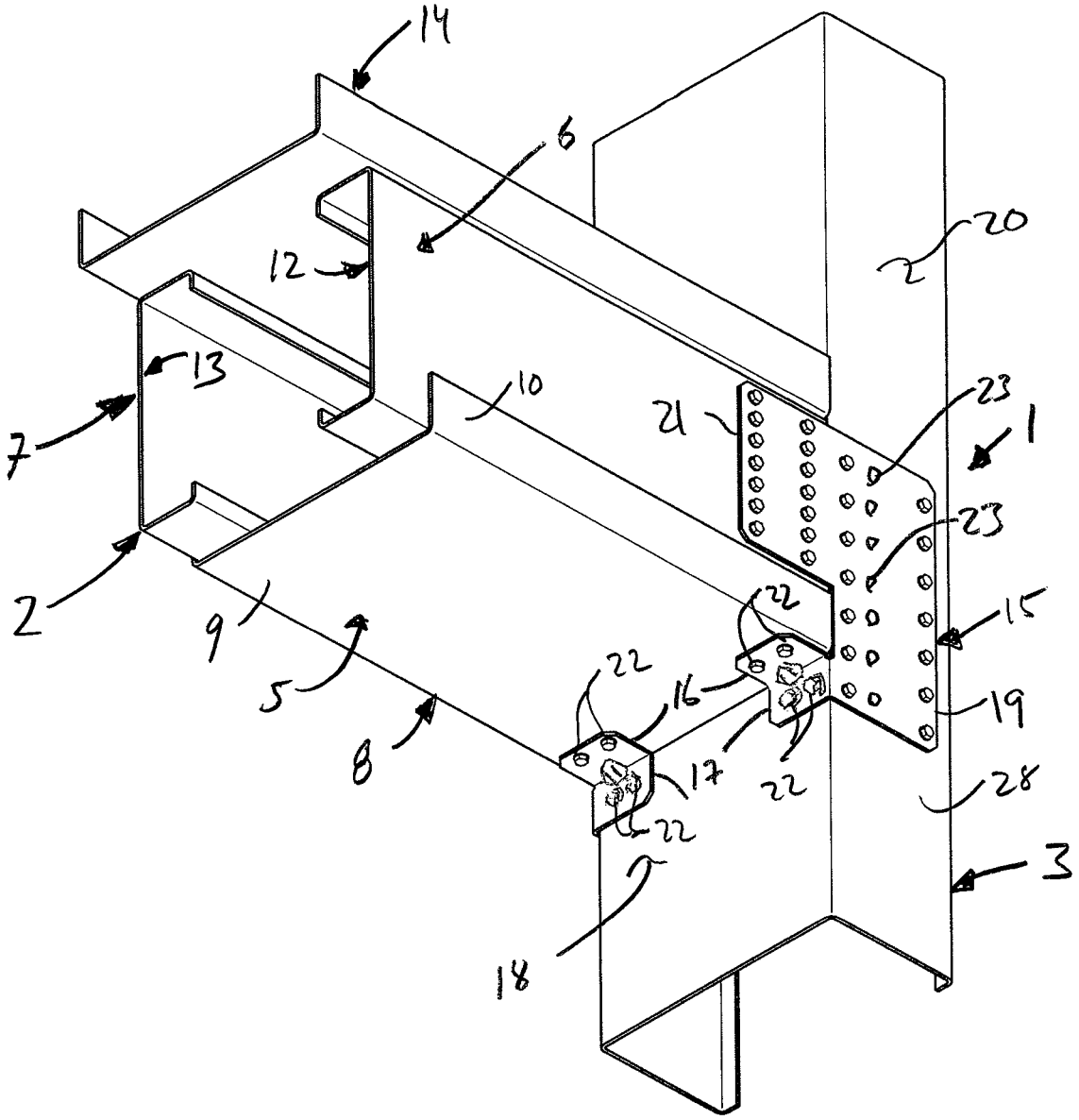
FIG. 9 is a perspective view of a connection of the present invention.

As shown in the FIGS. 2, 4 and 9, the side flange of the connector is attached to the vertical member, and the vertical member that receives fastener can be made up of one or two separate members, commonly known as jamb studs. The first jamb stud 28 is closer to the horizontal member and the horizontal member abuts or lies closely adjacent the jamb stud 28. The second jamb stud 29 is disposed closely adjacent to the first jamb stud 28. The jamb studs 28 and 29 can be different sizes.

The extension is preferably formed with two columns of openings 30 and 31. The columns of openings are arranged vertically on the connector when the connector is installed as shown in the figures. The side flange is formed with three columns of openings 32, 33 and 34. The two columns of openings closest to the extension are arranged closer to each other than are the two columns of openings arranged farther from the extension. That is to say, the closest column of openings to the extension 32 and the middle column of openings 33 are spaced closer to each other than the middle column of openings 33 and the farthest column of openings 34 from the extension. The closest opening to the extension 32 and the middle column of openings 33 are preferably spaced 23/32" from each other. The middle column of openings 33 and the farthest column of openings 34 from the extension are spaced 45/32" from each other. The closest column of openings to the extension and middle column of openings on the side flange are preferably spaced from the extension so that when the first jamb stud has side flanges that are only 1⅝" wide fasteners can be provided in both of the closest and middle column of openings and be received in the jamb stud. Two side-by-side columns of fasteners in the jamb stud makes for a strong connection. This arrangement is shown in FIG. 2. When two jamb studs are used that have side flanges that are 1⅝" wide and they are disposed next to each other with their side flanges aligned and the webs of the studs in parallel and spaced apart, fasteners can be placed in the closest column of openings to the extension and the farthest column of opening from the extension and each stud receives only the fasteners in the overlying column of openings. This balances the load on each of the studs. This arrangement is shown in FIG. 4.

I claim:

1. A connection between a header comprising a horizontal member and one or more vertically disposed members, formed with a connector, the connection comprising:

a. the horizontal member having a bottom face, an end and one or more side surfaces;

b. one or more vertical members extending orthogonally to the horizontal member with the horizontal member extending horizontally and the one or more vertical members extending vertically, with one of the one or more vertical members being closest to the end of the horizontal member, and the end of the horizontal member abutting or lying closely adjacent to a web vertical face of the one or more vertical members closest to the end of the horizontal member, the one or more vertical members extending past and above the end of the horizontal member and having vertical side surfaces:

c. the connector attached to the horizontal member and to at least one of the one or more vertical members, the connector including, 1. a first plate which attaches to the bottom face of the header with one or more fasteners;
2. a second plate which attaches to the web vertical face of the one or more vertical members closest to the end of the horizontal member with one or more fasteners;
3. a planar side flange projecting along the vertical side surfaces of the one or more vertical members with the planar side flange being joined to at least one of the vertical side surfaces of the one or more vertical members with one or more fasteners;
4. a side flange extension that extends in the plane of the side flange and extends along one of the one or more side surfaces of the horizontal member with the side flange extension being joined to one of the one or more side surfaces of the horizontal member with one or more fasteners;

d. wherein the horizontal member comprises:

1. a bottom c-shaped track, having a central web member and two side flanges projecting away from the central web member in the same direction, the bottom c-shaped track being oriented such that the central web member is disposed horizontally and constitutes the bottom face of the horizontal member;
2. a pair of upstanding c-shaped side members, each having a central web member and two end flanges projecting away from the central web member in the same direction, where the central web members of the c-shaped side members are disposed vertically and the bottom c-shaped track supports and partially encloses the upstanding c-shaped side members with one of the end flanges of each of the upstanding c-shaped members interfacing with the central web member of the bottom c-shaped track and portions of the central web members of the upstanding c-shaped side members and the side flanges of the bottom c-shaped track making up at least portions of the one or more side surfaces of the horizontal member, and the one or more side surface faces of the horizontal member have a flaring lower portion where the side flanges of the bottom c-shaped member jut out more than the central webs of the upstanding c-shaped side members, and e. wherein the side flange extension is attached to the side flange so that the side flange extension of the connector does not over-lie the flaring lower portion of the header.

2. The connection of claim 1, wherein:

the side flange extension is formed with two columns of openings arranged vertically for receiving the one or more fasteners.

3. The connection of claim 1, wherein:

one or more gusset darts are provided at the bend between the first and second plates.

4. The connection of claim 3, wherein:

the one or more gusset darts have central ribs that extend from the first plate to the second plate and flaring side walls.

5. A connection between a header comprising a horizontal member and one or more vertically disposed members, formed with a connector, the connection comprising:

a. the horizontal member having a bottom face, an end and one or more side surfaces;

b. one or more vertical members extending orthogonally to the horizontal member with the horizontal member extending horizontally and the one or more vertical members extending vertically, with one of the one or more vertical members being closest to the end of the horizontal member, and the end of the horizontal member abutting or lying closely adjacent to a web vertical face of the one or more vertical members closest to the end of the horizontal member, the one or more vertical members extending past and above the end of the horizontal member and having vertical side surfaces:

c. the connector attached to the horizontal member and to at least one of the one or more vertical members, the connector including, 1. a first plate which attaches to the bottom face of the header with one or more fasteners;
2. a second plate which attaches to the web vertical face of the one or more vertical members closest to the end of the horizontal member with one or more fasteners;
3. a planar side flange projecting along the vertical side surfaces of the one or more vertical members with the planar side flange being joined to at least one of the vertical side surfaces of the one or more vertical members with one or more fasteners;
4. a side flange extension that extends in the plane of the side flange and extends along one of the one or more side surfaces of the horizontal member with the side flange extension being joined to one of the one or more side surfaces of the horizontal member with one or more fasteners, wherein;

d. there is a free space in the connector between the side flange extension and the first plate.

6. A connection between a header comprising a horizontal member and one or more vertically disposed members, formed with a connector, the connection comprising:

a. the horizontal member having a bottom face, an end and one or more side surfaces;

b. one or more vertical members extending orthogonally to the horizontal member with the horizontal member extending horizontally and the one or more vertical members extending vertically, with one of the one or more vertical members being closest to the end of the horizontal member, and the end of the horizontal member abutting or lying closely adjacent to a web vertical face of the one or more vertical members closest to the end of the horizontal member, the one or more vertical members extending past and above the end of the horizontal member and having vertical side surfaces:

c. the connector attached to the horizontal member and to at least one of the one or more vertical members, the connector including, 1. a first plate which attaches to the bottom face of the header with one or more fasteners;
2. a second plate which attaches to the web vertical face of the one or more vertical members closest to the end of the horizontal member with one or more fasteners;
3. a planar side flange projecting along the vertical side surfaces of the one or more vertical members with the planar side flange being joined to at least one of the vertical side surfaces of the one or more vertical members with one or more fasteners;
4. a side flange extension that extends in the plane of the side flange and extends along one of the one or more side surfaces of the horizontal member with the side flange extension being joined to one of the one or more side surfaces of the horizontal member with one or more fasteners;

d. wherein the horizontal member comprises:

1. a bottom c-shaped track, having a central web member and two side flanges projecting away from the central web member in the same direction, the bottom c-shaped track being oriented such that the central web member is disposed horizontally and constitutes the bottom face of the horizontal member;
2. a pair of upstanding c-shaped side members, each having a central web member and two end flanges projecting away from the central web member in the same direction, where the central web members of the c-shaped side members are disposed vertically and the bottom c-shaped track supports and partially encloses the upstanding c-shaped side members with one of the end flanges of each of the upstanding c-shaped members interfacing with the central web member of the bottom c-shaped track and portions of the central web members of the upstanding c-shaped side members and the side flanges of the bottom c-shaped track making up at least portions of the one or more side surfaces of the horizontal member, wherein e. the side flange extension of the connector does not overlie the side flange of the c-shaped bottom track of the horizontal member.

7. A connection between a header comprising a horizontal member and one or more vertically disposed members, formed with a connector, the connection comprising:

a. the horizontal member having a bottom face, an end and one or more side surfaces;

b. one or more vertical members extending orthogonally to the horizontal member with the horizontal member extending horizontally and the one or more vertical members extending vertically, with one of the one or more vertical members being closest to the end of the horizontal member, and the end of the horizontal member abutting or lying closely adjacent to a web vertical face of the one or more vertical members closest to the end of the horizontal member, the one or more vertical members extending past and above the end of the horizontal member and having vertical side surfaces:

c. the connector attached to the horizontal member and to at least one of the one or more vertical members, the connector including, 1. a first plate which attaches to the bottom face of the header with one or more fasteners;

2. a second plate which attaches to the web vertical face of the one or more vertical members closest to the end of the horizontal member with one or more fasteners;

3. a planar side flange projecting along the vertical side surfaces of the one or more vertical members with the planar side flange being joined to at least one of the vertical side surfaces of the one or more vertical members with one or more fasteners;

4. a side flange extension that extends in the plane of the side flange and extends along one of the one or more side surfaces of the horizontal member with the side flange extension being joined to one of the one or more side surfaces of the horizontal member with one or more fasteners, and the side flange is formed with three columns of openings arranged vertically, a column of openings closest to the side flange extension, a column of openings farthest from the side flange extension and a middle column of openings, the column of openings closest to the side flange extension and the middle column of openings are arranged closer to each other than are the middle column of openings and the farthest column of openings from the side flange extension wherein d. fasteners are received in the closest column of openings to the side flange extension and the middle column of openings and the fasteners received in the closest column of openings to the side flange extension and the middle column of openings are received in a single one of the one or more vertical members.

8. The connection of claim 7, wherein:

the column of openings farthest from the side flange extension does not receive any fasteners.

9. The connection of claim 7, wherein:

a. the horizontal member comprises, 1. a bottom c-shaped track, having a central web member and two side flanges projecting away from the central web member in the same direction, the bottom c-shaped track being oriented such that the central web member is disposed horizontally and constitutes the bottom face of the horizontal member;

2. a pair of upstanding c-shaped side members, each having a central web member and two end flanges projecting away from the central web member in the same direction, where the central web members of the c-shaped side members are disposed vertically and the bottom c-shaped track supports and partially encloses the upstanding c-shaped side members with one of the end flanges of each of the upstanding c-shaped members interfacing with the central web member of the bottom c-shaped track and portions of the central web members of the upstanding c-shaped side members and the side flanges of the bottom c-shaped track making up at least portions of the one or more side surfaces of the horizontal member, b. the one or more side surface faces of the horizontal member has a flaring lower portion where the side flanges of the bottom c-shaped member jut out more than the central webs of the upstanding c-shaped side members, and wherein c. the side flange extension is attached to the side flange so that the side flange extension of the connector does not over-lie the flaring lower portion of the header.

10. The connection of claim 7, wherein:

a. the horizontal member comprises, 1. a bottom c-shaped track, having a central web member and two side flanges projecting away from the central web member in the same direction, the bottom c-shaped track being oriented such that the central web member is disposed horizontally and constitutes the bottom face of the horizontal member;

2. a pair of upstanding c-shaped side members, each having a central web member and two end flanges projecting away from the central web member in the same direction, where the central web members of the c-shaped side members are disposed vertically and the bottom c-shaped track supports and partially encloses the upstanding c-shaped side members with one of the end flanges of each of the upstanding c-shaped members interfacing with the central web member of the bottom c-shaped track and portions of the central web members of the upstanding c-shaped side members and the side flanges of the bottom c-shaped track making up at least portions of the one or more side surfaces of the horizontal member, and wherein b. the side flange extension of the connector does not overlie the side flange of the c-shaped bottom track of the horizontal member.

11. A connection between a header comprising a horizontal member and one or more vertically disposed members, formed with a connector, the connection comprising:

a. the horizontal member having a bottom face, an end and one or more side surfaces;

b. one or more vertical members extending orthogonally to the horizontal member with the horizontal member extending horizontally and the one or more vertical members extending vertically, with one of the one or more vertical members being closest to the end of the horizontal member, and the end of the horizontal member abutting or lying closely adjacent to a web vertical face of the one or more vertical members closest to the end of the horizontal member, the one or more vertical members extending past and above the end of the horizontal member and having vertical side surfaces:

c. the connector attached to the horizontal member and to at least one of the one or more vertical members, the connector including,
   1. a first plate which attaches to the bottom face of the header with one or more fasteners;
   2. a second plate which attaches to the web vertical face of the one or more vertical members closest to the end of the horizontal member with one or more fasteners;
   3. a planar side flange projecting along the vertical side surfaces of the one or more vertical members with the planar side flange being joined to at least one of the vertical side surfaces of the one or more vertical members with one or more fasteners;
   4. a side flange extension that extends in the plane of the side flange and extends along one of the one or more side surfaces of the horizontal member with the side flange extension being joined to one of the one or more side surfaces of the horizontal member with one or more fasteners, and the side flange is formed with three columns of openings arranged vertically, a column of openings closest to the side flange extension, a column of openings farthest from the side flange extension and a middle column of openings wherein d. fasteners are received in the closest column of openings to the side flange extension and the farthest column of openings from the side flange extension and the fasteners received in the closest column of openings to the side flange are received in one of the one or more vertical members and the fasteners received in the farthest column of openings from the side flange extension are received in a different one of the one or more vertical members.

12. The connection of claim 11, wherein:

the middle column of openings does not receive any fasteners.

13. The connection of claim 11, wherein:

a. the horizontal member comprises,
   1. a bottom c-shaped track, having a central web member and two side flanges projecting away from the central web member in the same direction, the bottom c-shaped track being oriented such that the central web member is disposed horizontally and constitutes the bottom face of the horizontal member;
   2. a pair of upstanding c-shaped side members, each having a central web member and two end flanges projecting away from the central web member in the same direction, where the central web members of the c-shaped side members are disposed vertically and the bottom c-shaped track supports and partially encloses the upstanding c-shaped side members with one of the end flanges of each of the upstanding c-shaped members interfacing with the central web member of the bottom c-shaped track and portions of the central web members of the upstanding c-shaped side members and the side flanges of the bottom c-shaped track making up at least portions of the one or more side surfaces of the horizontal member, b. the one or more side surface faces of the horizontal member has a flaring lower portion where the side flanges of the bottom c-shaped member jut out more than the central webs of the upstanding c-shaped side members, and wherein c. the side flange extension is attached to the side flange so that the side flange extension of the connector does not over-lie the flaring lower portion of the header.

14. The connection of claim 11, wherein:

a. the horizontal member comprises,
   1. a bottom c-shaped track, having a central web member and two side flanges projecting away from the central web member in the same direction, the bottom c-shaped track being oriented such that the central web member is disposed horizontally and constitutes the bottom face of the horizontal member;
   2. a pair of upstanding c-shaped side members, each having a central web member and two end flanges projecting away from the central web member in the same direction, where the central web members of the c-shaped side members are disposed vertically and the bottom c-shaped track supports and partially encloses the upstanding c-shaped side members with one of the end flanges of each of the upstanding c-shaped members interfacing with the central web member of the bottom c-shaped track and portions of the central web members of the upstanding c-shaped side members and the side flanges of the bottom c-shaped track making up at least portions of the one or more side surfaces of the horizontal member, and wherein b. the side flange extension of the connector does not overlie the side flange of the c-shaped bottom track of the horizontal member.

15. A connection between a header comprising a horizontal member and one or more vertically disposed members, formed with a connector, the connection comprising:

a. the horizontal member having a bottom face, an end and one or more side surfaces;

b. one or more vertical members extending orthogonally to the horizontal member with the horizontal member extending horizontally and the one or more vertical members extending vertically, with one of the one or more vertical members being closest to the end of the horizontal member, and the end of the horizontal member abutting or lying closely adjacent to a web vertical face of the one or more vertical members closest to the end of the horizontal member, the one or more vertical members extending past and above the end of the horizontal member and having vertical side surfaces:

c. the connector attached to the horizontal member and to at least one of the one or more vertical members, the connector including,
   1. a first plate which attaches to the bottom face of the header with one or more fasteners;
   2. a second plate which attaches to the web vertical face of the one or more vertical members closest to the end of the horizontal member with one or more fasteners;
   3. a planar side flange projecting along the vertical side surfaces of the one or more vertical members with the planar side flange being joined to at least one of the vertical side surfaces of the one or more vertical members with one or more fasteners;
   4. a side flange extension that extends in the plane of the side flange and extends along one of the one or more side surfaces of the horizontal member with the side flange extension being joined to one of the one or more side surfaces of the horizontal member with one or more fasteners, the second plate is attached to the first plate at an orthogonal bend, the side flange is joined directly to the second plate at an orthogonal bend wherein:

d. the side flange and the side flange extension are only connected to the first plate through the connection to the second plate.

16. The connection of claim 15, wherein the horizontal member comprises:

a. a bottom c-shaped track, having a central web member and two side flanges projecting away from the central web member in the same direction, the bottom c-shaped track being oriented such that the central web member is disposed horizontally and constitutes the bottom face of the horizontal member;

b. a pair of upstanding c-shaped side members, each having a central web member and two end flanges projecting away from the central web member in the same direction, where the central web members of the c-shaped side members are disposed vertically and the bottom c-shaped track supports and partially encloses the upstanding c-shaped side members with one of the end flanges of each of the upstanding c-shaped members interfacing with the central web member of the bottom c-shaped track and portions of the central web members of the upstanding c-shaped side members and the side flanges of the bottom c-shaped track making up at least portions of the one or more side surfaces of the horizontal member.

17. The connection of claim 16, wherein:

the side flange extension of the connector does not overlie the side flange of the c-shaped bottom track of the horizontal member.

* * * * *